US011066130B2

(12) United States Patent
Harrod

(10) Patent No.: US 11,066,130 B2
(45) **Date of Patent: *Jul. 20, 2021**

(54) SYSTEM FOR SECURING A FLOATING STRUCTURE WITH ONE OR MORE TENSION DEVICES

(71) Applicant: Bruce Harrod, Gaines, MI (US)

(72) Inventor: Bruce Harrod, Gaines, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/016,810

(22) Filed: Jun. 25, 2018

(65) Prior Publication Data

US 2018/0304972 A1 Oct. 25, 2018
US 2020/0398941 A9 Dec. 24, 2020

Related U.S. Application Data

(63) Continuation-in-part of application No. 15/476,960, filed on Mar. 31, 2017, now Pat. No. 10,144,489.

(60) Provisional application No. 62/315,965, filed on Mar. 31, 2016.

(51) Int. Cl.
*B63B 21/26* (2006.01)
*B63B 21/50* (2006.01)
*B63B 21/00* (2006.01)

(52) U.S. Cl.
CPC ..... *B63B 21/26* (2013.01); *B63B 21/502* (2013.01); *B63B 2021/005* (2013.01)

(58) Field of Classification Search
CPC ..... B63B 21/50; B63B 21/26; E02D 5/74; E02D 5/801; E02D 5/54
USPC ..... 114/295, 230.2
See application file for complete search history.

(56) References Cited

U.S. PATENT DOCUMENTS 1,883,477 A * 10/1932 Bash ..... E02D 5/801 52/157
2,680,859 A * 6/1954 Hultberg ..... B63B 22/02 441/3
2,999,572 A * 9/1961 Hinckley ..... E02D 5/801 52/156
3,158,127 A * 11/1964 Gallaugher ..... B63B 21/29 114/300
3,931,656 A * 1/1976 Thomson ..... B63B 35/7933 441/75
4,785,758 A * 11/1988 Eichelberger, Sr. .... B63B 21/46 114/299
4,793,276 A * 12/1988 Stafford ..... B63B 21/30 114/300

(Continued)

FOREIGN PATENT DOCUMENTS

DE 102006055640 A1 * 7/2008 ..... E02D 5/801
DE 102008011869 A1 * 9/2009 ..... E02D 5/801
WO WO-2010091702 A1 * 8/2010 ..... E02D 5/801

*Primary Examiner* — Anthony D Wiest
(74) *Attorney, Agent, or Firm* — Stephen T. Olson; Harness, Dickey & Pierce, P.L.C.

(57) ABSTRACT

A tension device for securing a floating structure to a fixed point includes an elastic member and an inelastic member. The elastic member has a length between a first end and a second end thereof. The length is elastically variable under tension. The inelastic member limits elongation of the length of the elastic member. The tension device has a first length when the elastic member is not under tension and a longer length when the elastic member is elastically stretched by a tension force. The inelastic member limits elastic elongation of the elastic member to a second length.

17 Claims, 12 Drawing Sheets

(56) References Cited

U.S. PATENT DOCUMENTS

| | | | | | |
|---|---|---|---|---|---|
| 5,205,803 | A * | 4/1993 | Zemitis | A63B 21/0552 | 482/121 |
| 5,720,235 | A * | 2/1998 | Bartkus | B63B 21/32 | 114/300 |
| 5,852,985 | A * | 12/1998 | Fisher | B63B 21/26 | 114/296 |
| 6,390,009 | B2 * | 5/2002 | Brown | B63B 21/00 | 114/230.24 |
| 6,857,216 | B1 * | 2/2005 | Merin | A01M 31/06 | 114/294 |
| 7,175,574 | B2 * | 2/2007 | Carmel | A63B 21/0004 | 482/124 |
| 9,550,086 | B1 * | 1/2017 | Poirier | A63B 71/0054 | |
| 9,616,974 | B2 * | 4/2017 | Martindale | E02D 5/801 | |
| 10,384,094 | B1 * | 8/2019 | Newman | A63B 1/00 | |
| 2001/0032576 | A1 * | 10/2001 | Brown | B63B 21/00 | 114/230.1 |
| 2015/0101524 | A1 * | 4/2015 | Pence | B63B 21/243 | 114/294 |

* cited by examiner

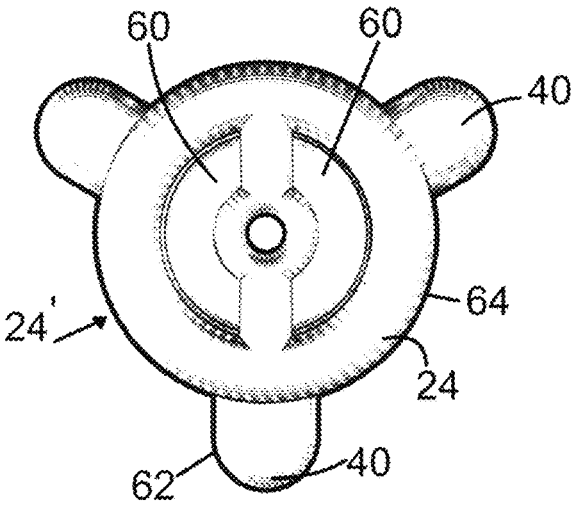
Figure 12a
Figure 12b
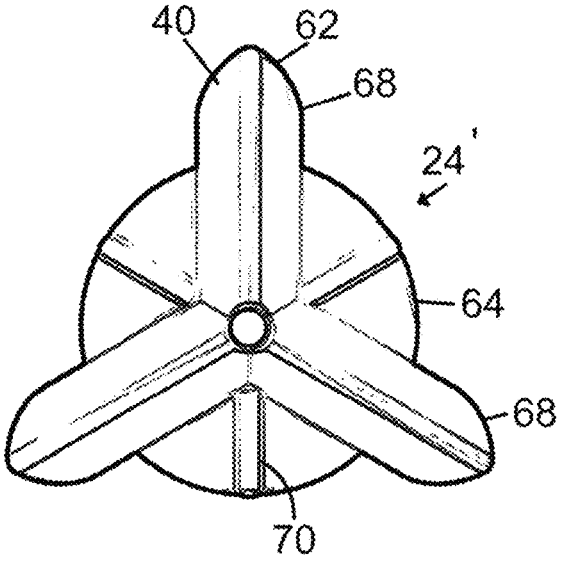
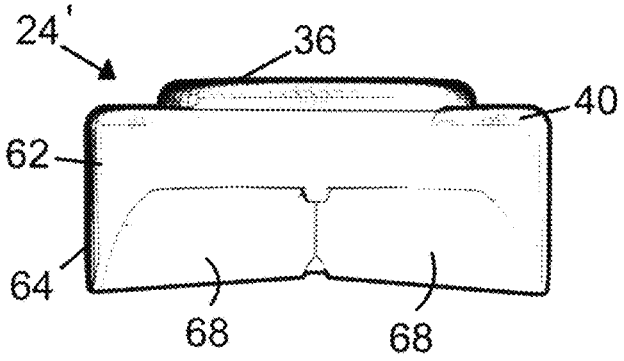
Figure 12c
Figure 12d
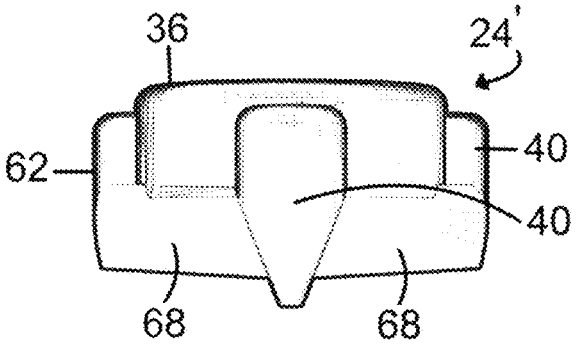

SYSTEM FOR SECURING A FLOATING STRUCTURE WITH ONE OR MORE TENSION DEVICES

CROSS-REFERENCE TO RELATED APPLICATIONS

This application claims the priority of U.S. Non-Provisional application Ser. No. 15/476,960 filed 31 Mar. 2017 which claims the benefit of U.S. Provisional Application No. 62/315,965 filed on 31 Mar. 2016. The entire disclosure of the above application is incorporated herein by reference.

FIELD

The present teachings generally relate to a system for securing a floating structure. More particularly, the present teachings relate to a system for securing a floating structure, including but not limited to a boat, utilizing one or more tension devices. The present teachings also relate to a tension device for such a system.

BACKGROUND

This section provides background information related to the present disclosure which is not necessarily prior art.

Boats and other floating structures are commonly secured in the water with simple lines or ropes. For example, a boat may be secured to an anchor, dock or other fixed structure. Under certain conditions, such securement with simple lines or ropes may fail or cause damage. In this regard, wind and wave action may repetitively introduce slack and tension. This repeated cycle of slack and tension may cause an anchor to lose purchase.

To a more limited extent, it is known use elastic lines for securing a boat. While known elastic lines may have proven to be acceptable for certain applications, they are all associated with limitations. Accordingly, a need in the art remains for improvement.

SUMMARY

This section provides a general summary of the disclosure, and is not a comprehensive disclosure of its full scope or all of its features.

According to one particular aspect, the present teachings provide a system for securing a floating structure including an anchor and a tension device. The anchor has a disk shaped member, a plurality of paddles and a plurality of fins. The disk shaped member has a top surface defining a locking surface, a bottom circular surface, and a periphery surface disposed between the top and bottom surfaces. The disk shaped member further has a diameter greater than a height. The plurality of paddles radially extend from the periphery surface. The plurality of fins is on the bottom surface. The tension device includes an elastic member and an inelastic member. The elastic member has an elastically variable length elongatable more than 200%. The inelastic.

According to another particular aspect, the present teachings provide a tension device for coupling a floating structure to a fixed point. The tension device includes an elastic member and an inelastic member. The elastic member has a length between a first end and a second end thereof. The length is elastically variable under tension. The inelastic member functions for limiting elongation of the length of the elastic member. The tension device has a first length when the elastic member is not under tension and a longer length when the elastic member is elastically stretched by a tension force. The inelastic member limits elastic elongation of the elastic member to a second length. According to yet another particular aspect, the present teachings provide a method of securing a floating structure relative to a fixed point. The method includes providing a tension device including an elastic member and an inelastic member. The inelastic member surrounds the elastic member. The tension device has a first length when no subject to tension forces. The method additionally includes connecting the floating structure to the fixed point with the tension device. The method further includes elongating the elastic member by more than 200% and limiting elongation of the elastic member with the inelastic member.

DRAWINGS

The drawings described herein are for illustrative purposes only of selected embodiments and not all possible implementations, and are not intended to limit the scope of the present disclosure.

Figure 7D:
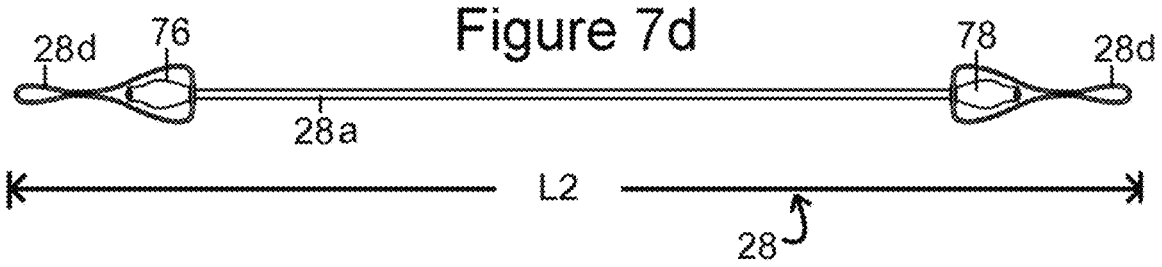
Figure 7B:
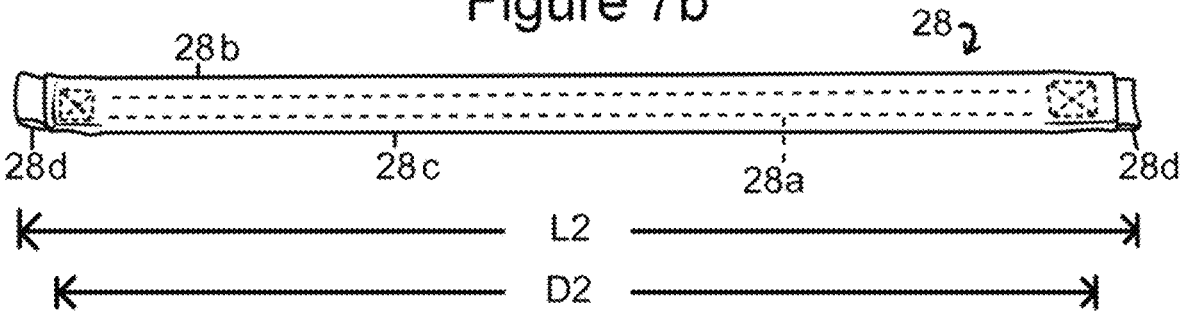
Figure 7C:
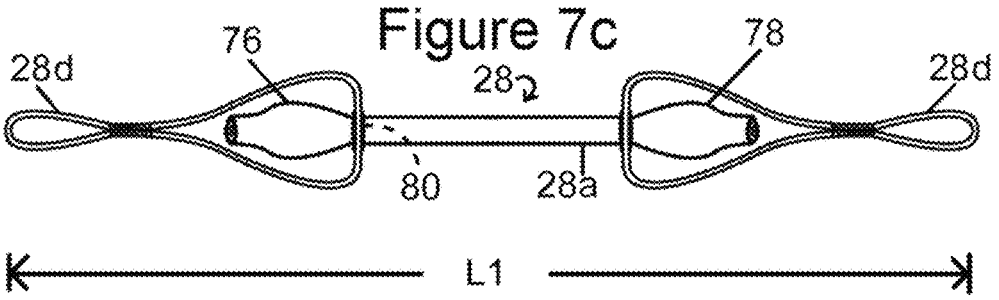
Figure 7A:
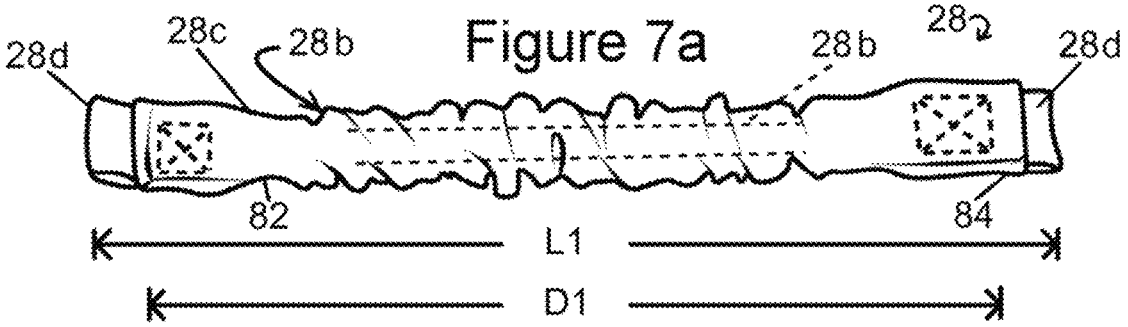

FIG. 7*a* further illustrates one of the tension devices of the securing system of the present teachings, the tension device shown unstretched.

FIG. 7*b* is a further view of the tension device of FIG. 7*a*, the tension device shown fully elongated.

FIG. 7*c* is another view of the tension device of FIG. 7*a*, an outer inelastic covering of the tension device shown removed for purposes of illustration.

FIG. 7*d* is another view of the tension device shown with the inelastic veering removed, the tension device shown fully elongated.

Figure 8:
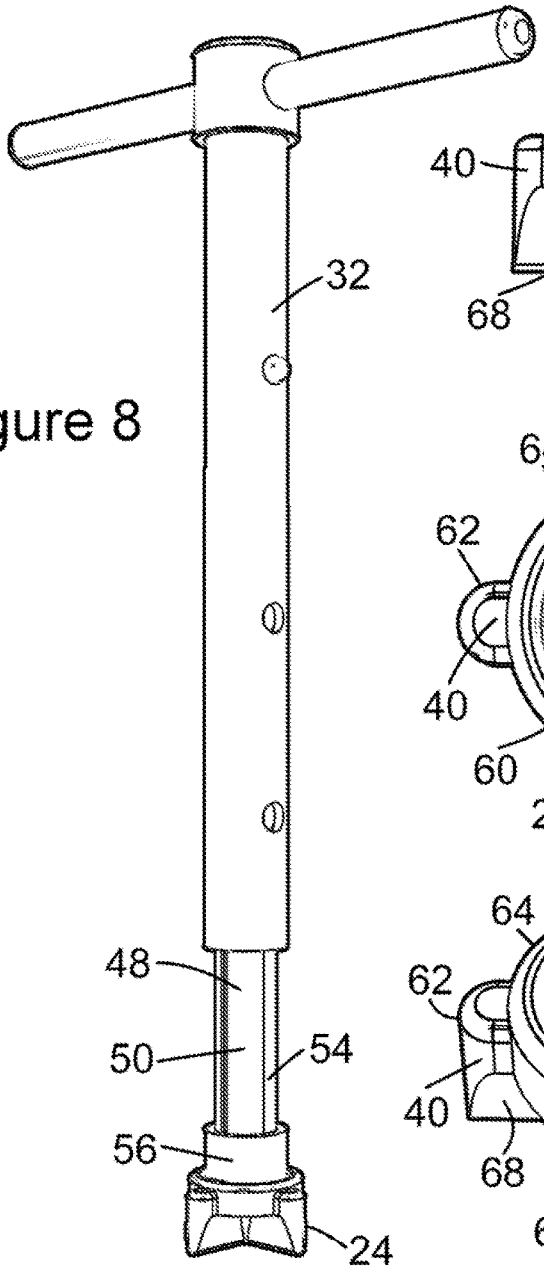

FIG. 8 represents the coupling of a tool to the anchor.

Figure 9A:
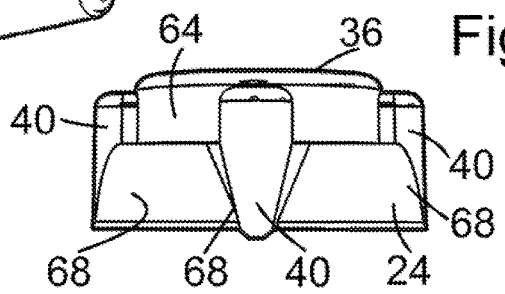
Figure 9B:
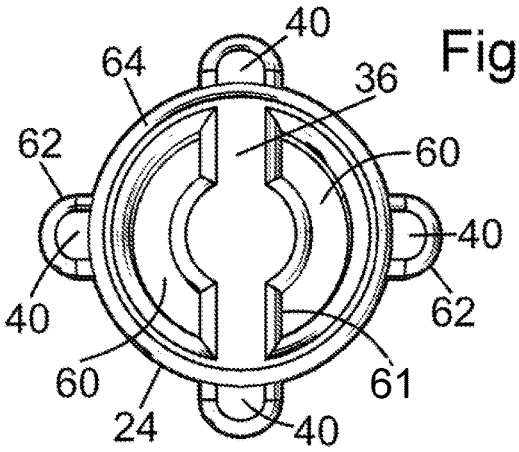
Figure 9C:
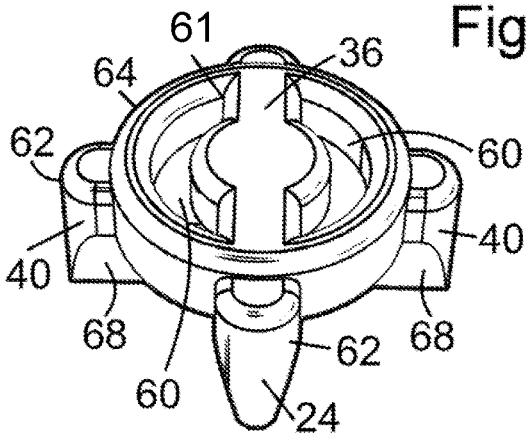

FIGS. 9*a*-9*c* represents anchors according to the present teachings.

Figure 10:
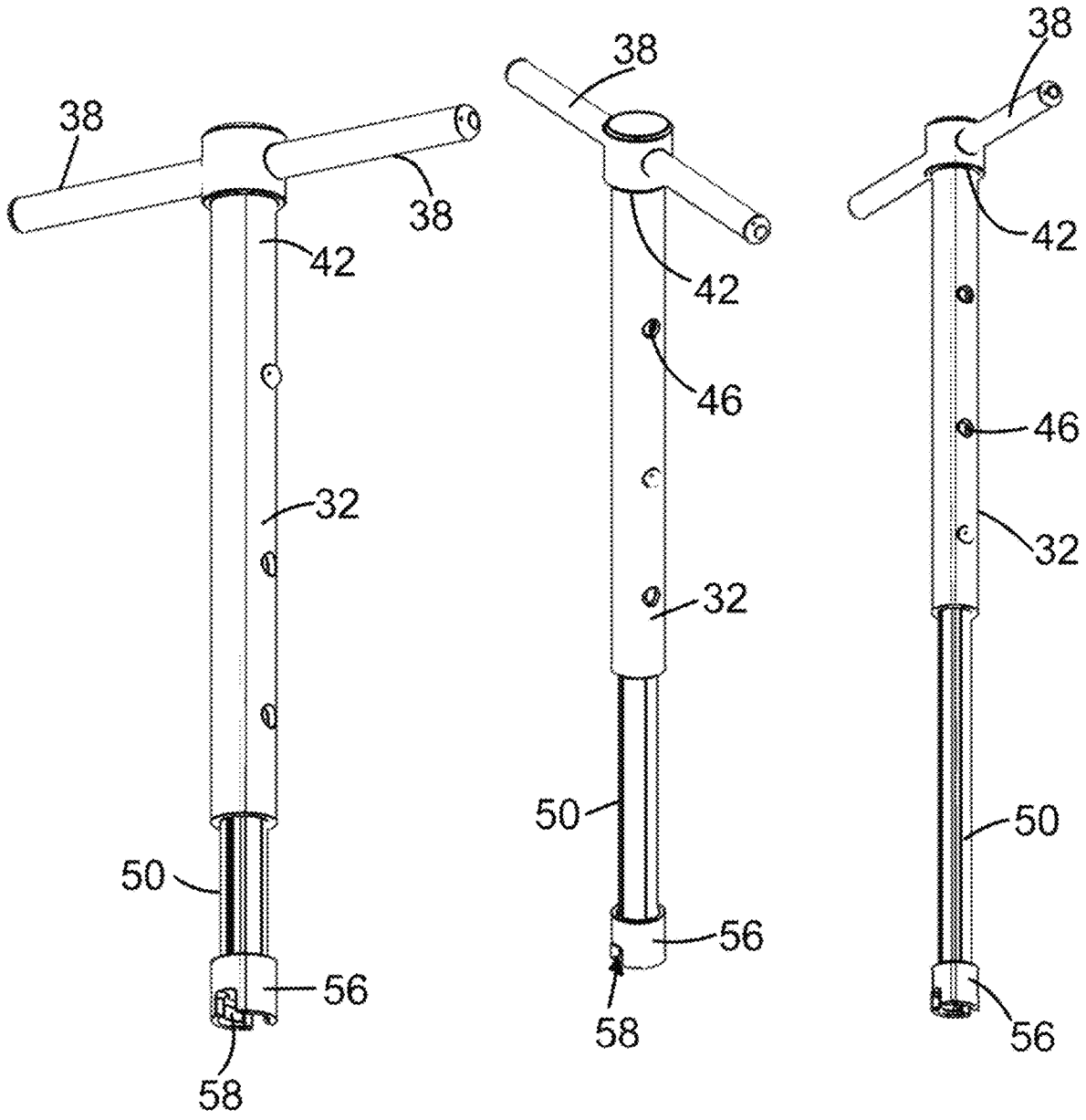
Figure 11A:
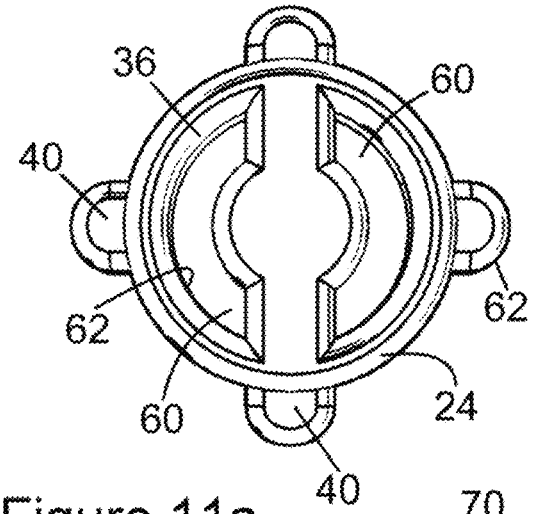
Figure 11B:
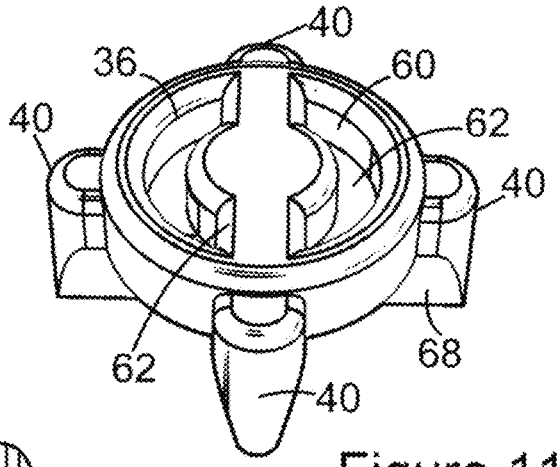
Figure 11C:
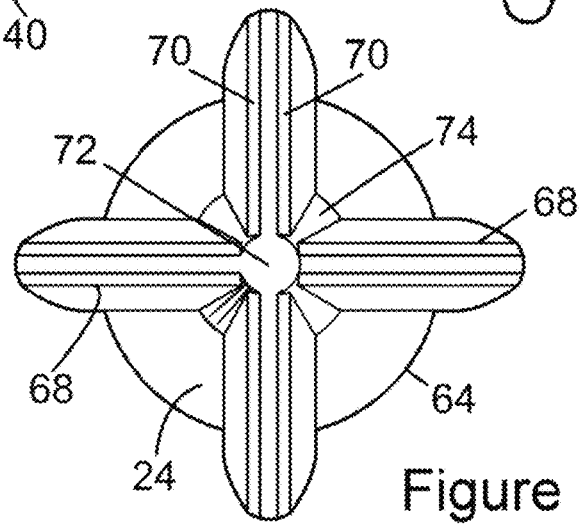
Figure 11D:
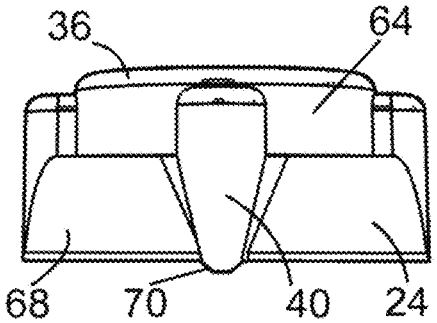
Figure 11E:
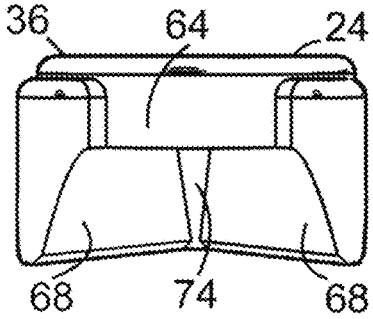

FIG. 10 represents three insertion tools.

FIGS. 11*a*-11*e* represent various views of the anchor shown in FIGS. 1-7.

FIGS. 12*a*-12*d* represent an alternate anchor according to the present teachings.

Figure 13:
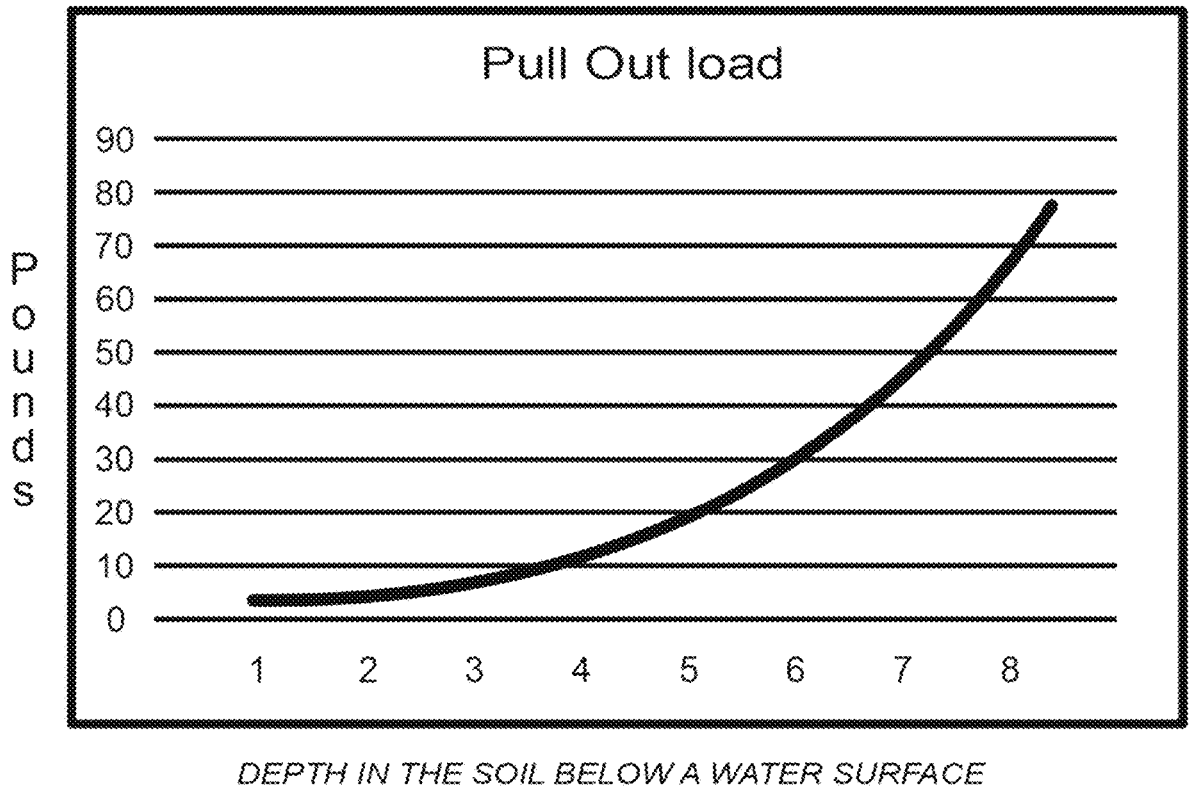

FIG. 13 represents load vs insertion depth.

Corresponding reference numerals indicate corresponding parts throughout the several views of the drawings.

DETAILED DESCRIPTION

Example embodiments will now be described more fully with reference to the accompanying drawings.

Figure 1:
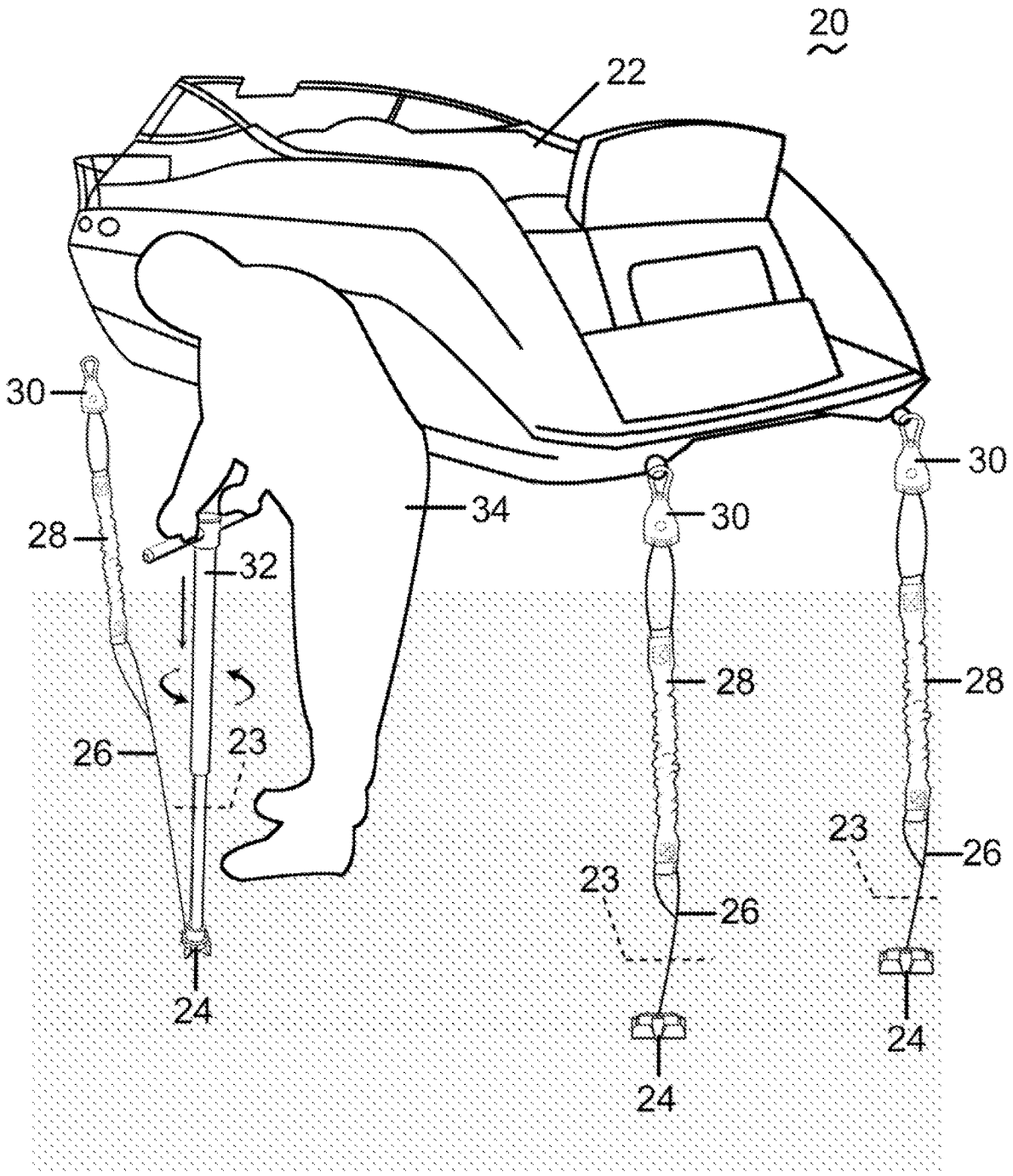
FIG. 1 is an environmental perspective view of a securing system for a floating structure according to the present teachings, the securing system shown being installed to secure a boat to a sand bar.
Figure 2:
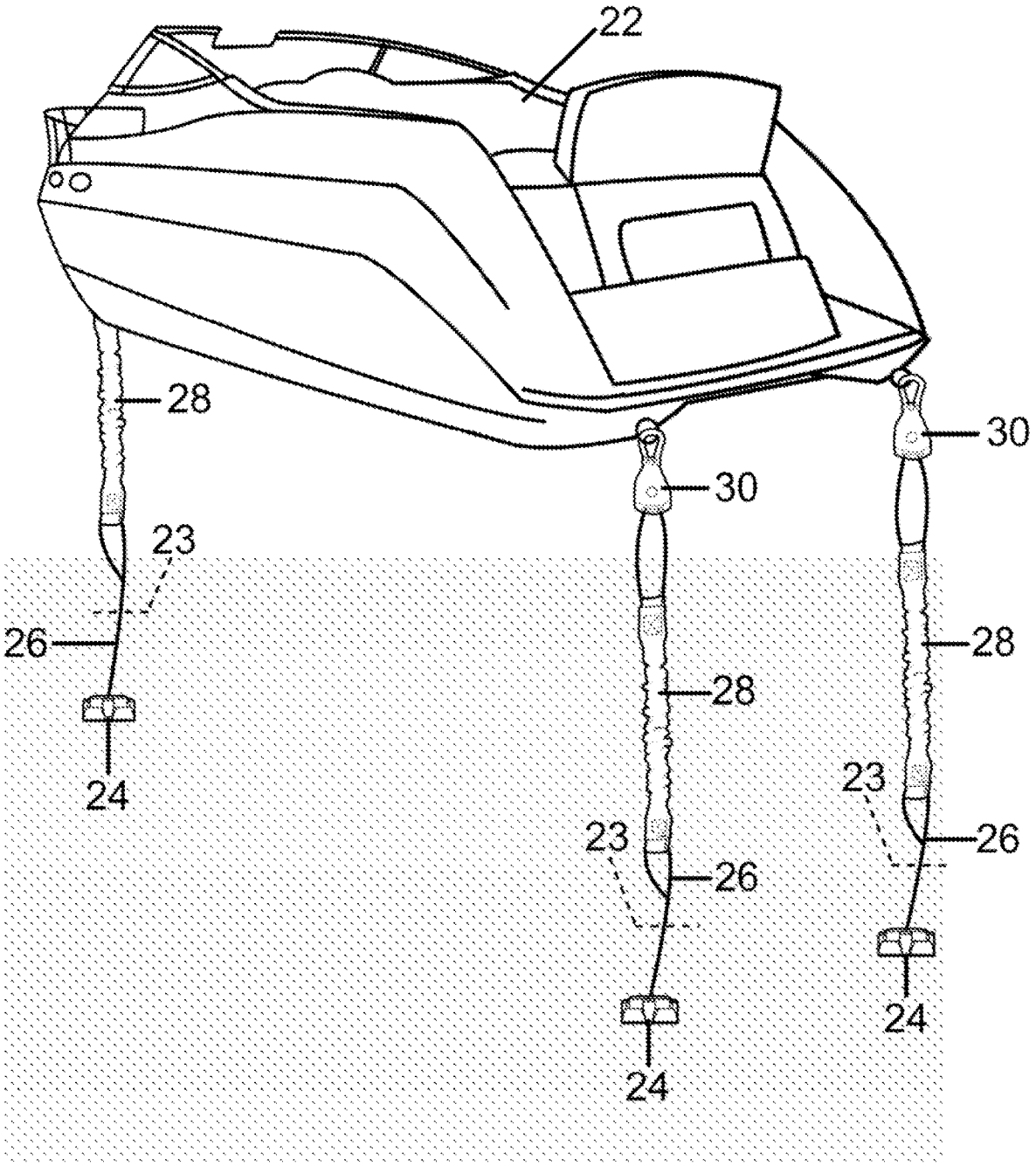
FIG. 2 is an environmental perspective view similar to FIG. 1 showing the secured boat.

FIGS. 1 and 2 represent a system for securing a floating structure 20 according to the present teachings. In the particular application illustrated, the floating structure is a boat 22. As will be appreciated more fully below, the present teachings or no so limited.

In accordance with one particular application, the boat securing system 20 is particularly adapted to restrict the movement of the boat 22 with respect to a ground surface 23 under water. The securing system 20 generally includes an anchor 24. As will be described below is inserted in the ground or sand beneath the ground surface 23. Generally, the anchor 24 can have a density of less than water and can therefore float.

Attached to the anchor 24 is a first coupling cord 26, which is coupled to a tension device 28. The construction of the tension device 28 and alternative uses of the tension device 28 are further described below. In the application illustrated, the tension devices 28 provide for constant tension between the anchor 24 and the coupling to the boat 22. At an opposite end of the tension device 28 is a boat coupling 30 which may be fixed to various locations on the boat 22. A user 34 uses an extendable insertion tool 32 that is agitated and rotated to drive the anchor 24 into the ground or sand. The boat couplings 30 can be coupled to a bow and stern of the boat in a manner which placed the anchors generally below the boat so that the first coupling cord emerges from the ground surface 23. In some applications, it may be desirable to position the anchors generally below the corresponding boat coupling point such that the coupling cord extends generally perpendicular to the ground surface.

Figure 3:
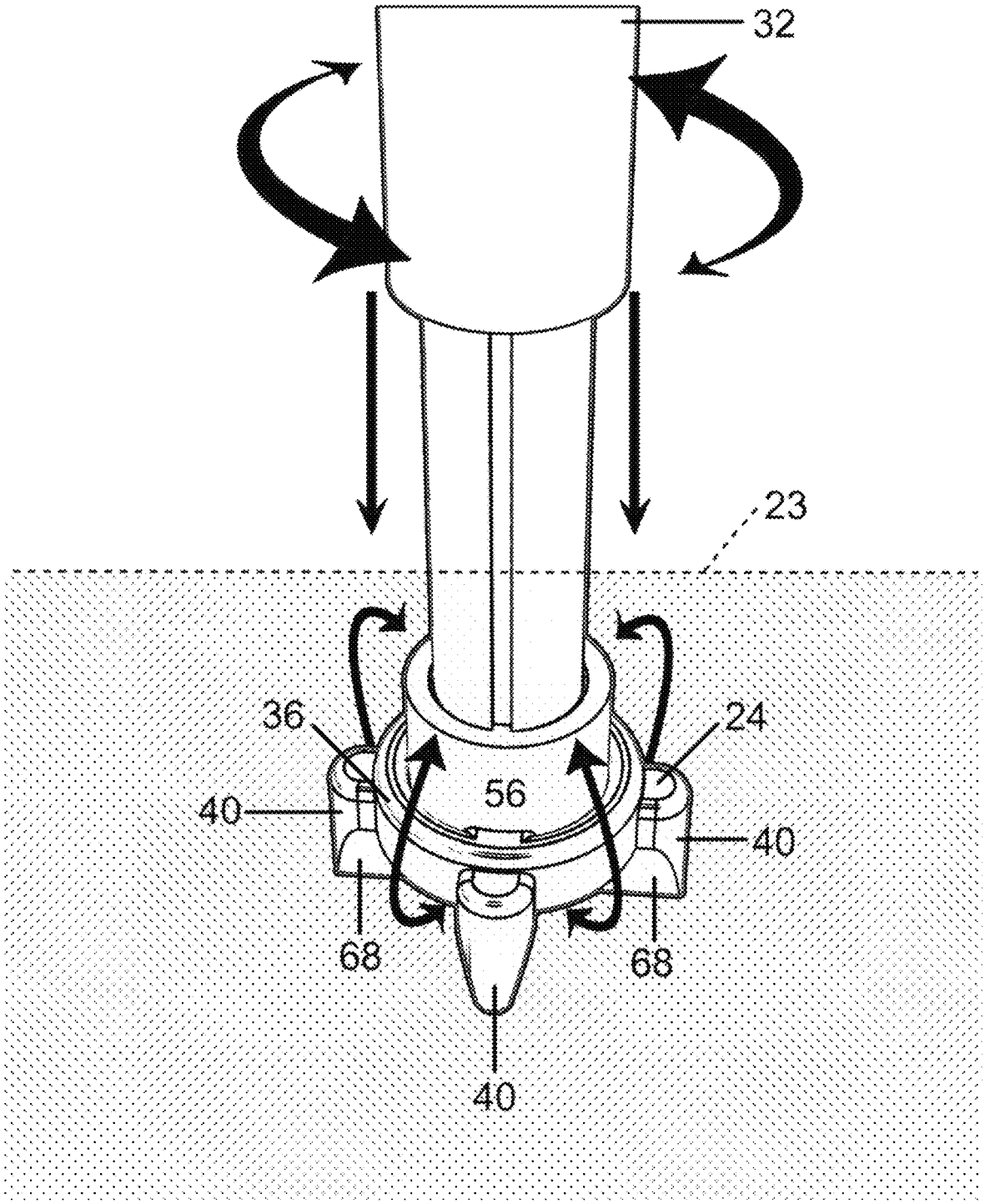
FIG. 3 is another environmental view further illustrating insertion of one of the anchors shown in FIG. 1.

FIG. 3 represents the insertion of the anchor 24 shown in FIGS. 1. As described below, the insertion tool 32 is coupled to a top surface of the anchor 24. During the insertion of the anchor 24, the user 34 presses on a pair of handles 38 while agitating the anchor 24 in a back and forth rotating manner with the insertion tool 32, thus advancing the anchor 24 into the ground surface 23. The anchor 24 effectively burrows under the sand. The anchor 24 has a plurality of exterior paddle projections 40 which facilitate the movement of sand from below the anchor 24 to above the anchor 24.

Figure 4:
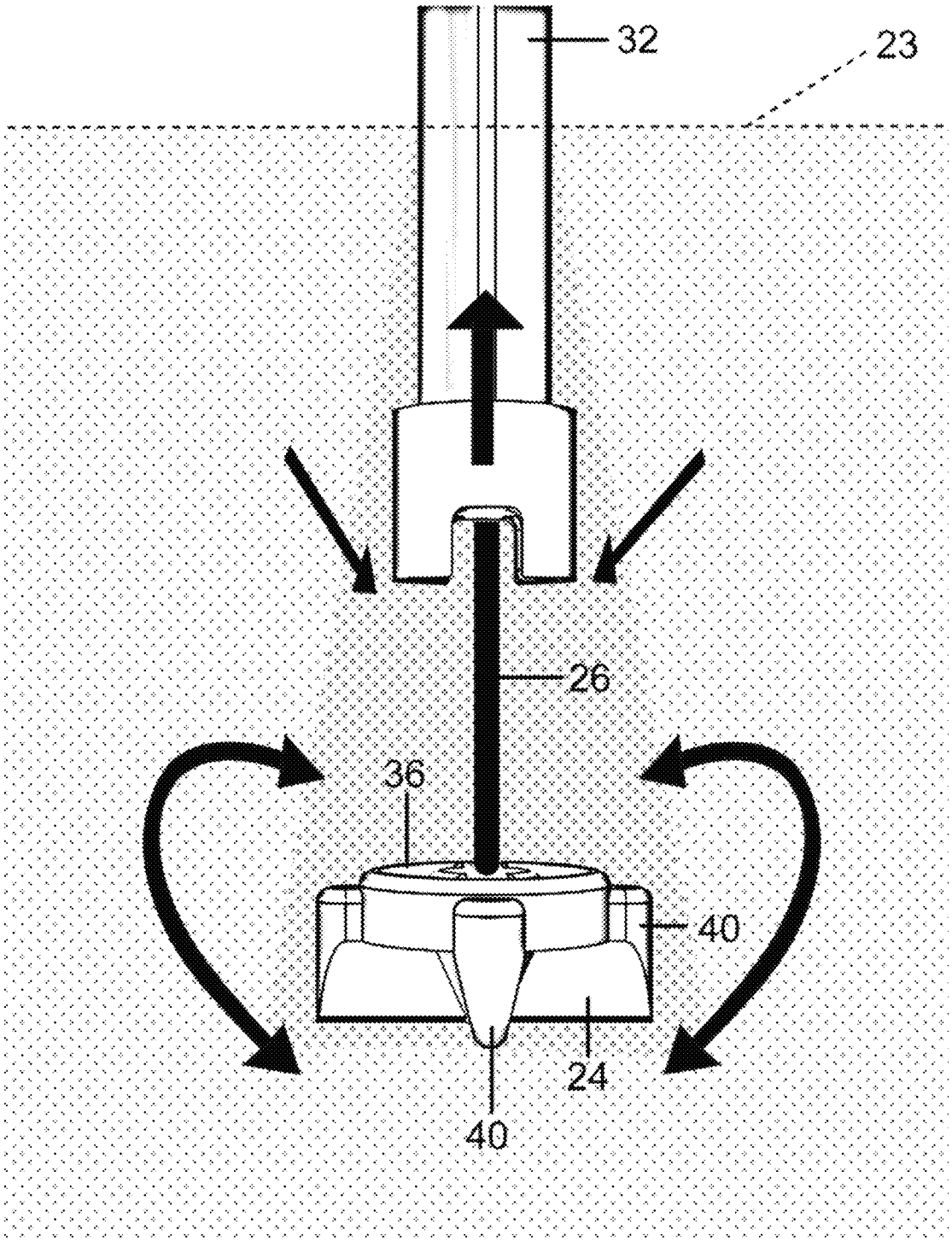
FIG. 4 is an exploded view of the anchor of FIG. 1 and a tool illustrating removal of the anchor.

FIG. 4 represents detachment of the insertion tool 32 leaving the anchor 24 below the ground surface 23. During the extraction of the insertion tool 32, sand from locations adjacent to the tool, collapses into the space left by the removed tool 32. During application of a suction disc, numerous processes are taking place simultaneously to assist an efficient and effective anchor set. During the setting procedure, downward force is applied to the applicator handle while agitating the handle. This agitation and downward force causes the cutting face of the slurry fins on the bottom of the device to scrape the topmost later of sand in the boring area, liberating it from its' hard pack condition.

At the same time, the agitation causes the side faces of the slurry fins to generate an agitated water movement. Once free from the hard pack, the sand grains are then "picked up" and suspended by the water being agitated by the slurry fins creating a slurry material. At the same time, the downward force of the disc during this procedure cause a positive pressure to build in the slurry chambers below the disc. This positive pressure forces the slurry to evacuate from the area below the disc, through the slurry gaps, and make its' way to the top side of the disc. Once the material is on the top side of the disc, the water motion decreases causing the sand to settle again, allowing the water to return to the bottom side of the disc to repeat the process.

The sand on the top side of the disc will settle as the application process occurs creating a "seal" which traps the water in the lower slurry chamber area. When the proper depth of set is reached (as indicated on the depth gauge), the applicator is removed and the water from the slurry chamber is able to escape through the hole that the applicator stem leaves when removed. The applicator is hollow and vented for at least two reasons. First, to prevent the applicator stem from creating suction when removed after installation (This causes removal to be more difficult and may dislodge the disc). Secondly, removal of our vented applicator design releases air bubbles during removal which helps to extend the time that the applicator stem hole has to settle properly without trapping water below the sand.

Figure 5:
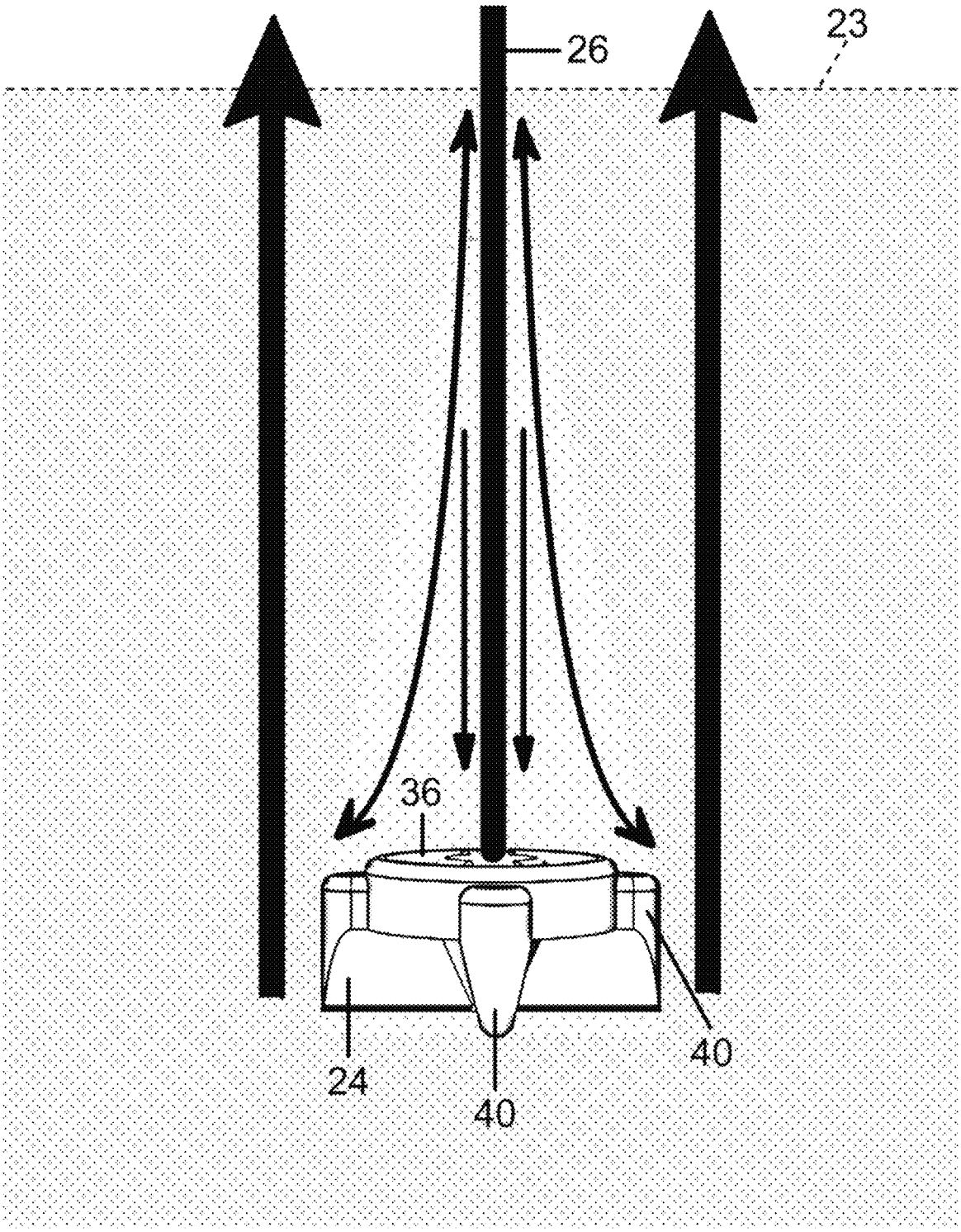
FIG. 5 is a perspective view of an inserted anchor illustrating the forces on the inserted anchor.
Figure 6:
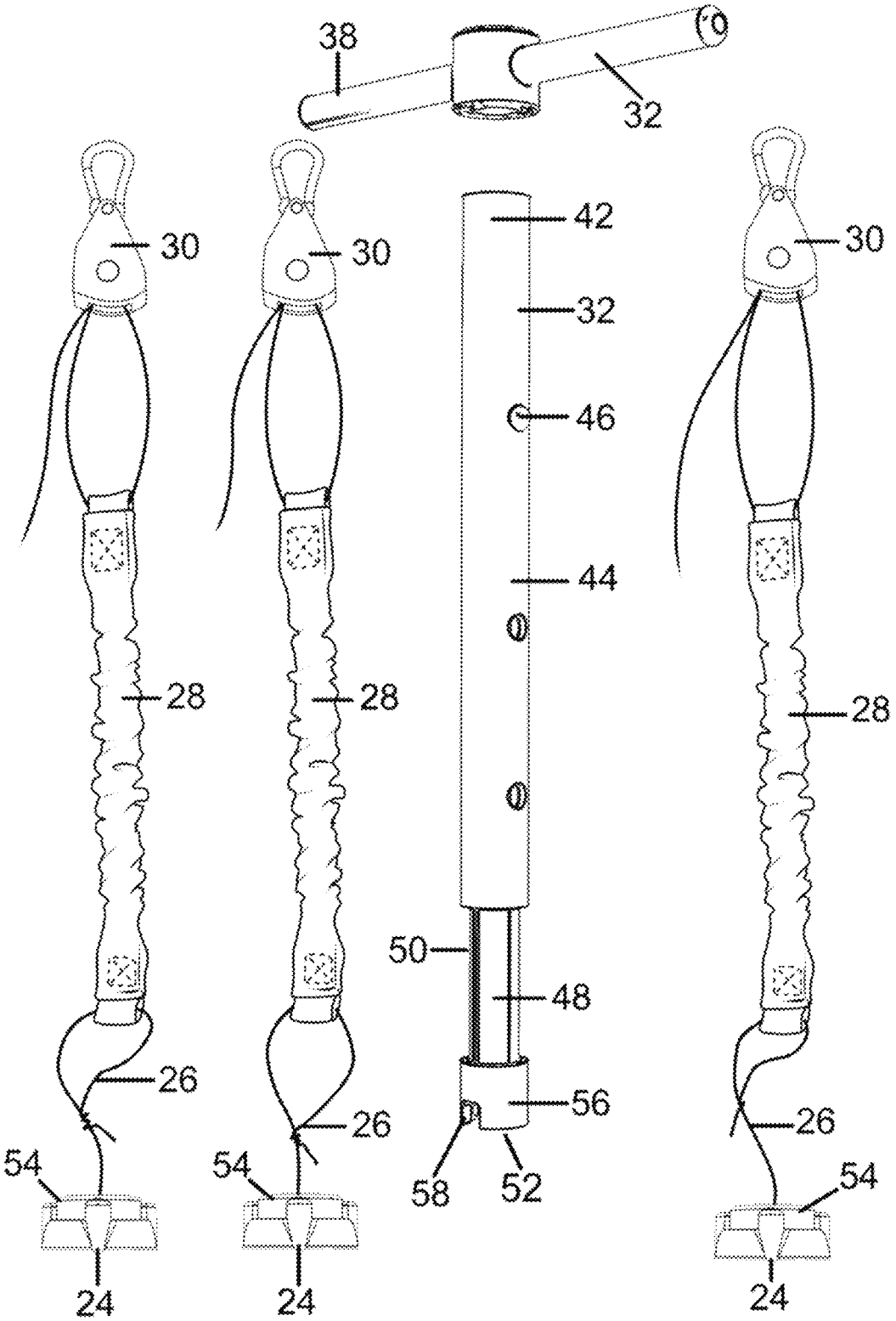
FIG. 6 illustrates a kit of components associated with present teachings.

FIG. 5 represent the forces on the set anchor 24. When a load is applied to the first coupling cord 26, the top surface 36 of the anchor 24 functions to load onto the wet sand and ground immediately above the top surface of the anchor 24. Interaction of independent sand particles restrict movement of the anchor with respect to the ground surface. As will be shown in FIG. 13, the load needed to displace the anchor 24 above the ground surface 23 is a function of the depth the anchor 24 is positioned below the ground surface 23.

As shown in FIGS. 6-8 and 10 represent a kit of components associated with present teachings. The insertion tool 32 has a first end 42 which is configured to couple a shaft with the handle 38. The insertion tool 42 has a first exterior tube 44 which has a plurality of coupling features 46. Disposed within the exterior tube 44 is an interior tube 48 which is slidably disposed within the exterior tube 44. Disposed between the interior tube 48 and the interior tube is a locking surface 50 which prevents relative rotation of the interior tube 48 and the exterior tube 44. The coupling features 46 function to lock the axial movement of the exterior tube 44 with respect to the interior tube 48.

Disposed at a second end of the insertion tool 32 is an anchor coupling feature 52 which functions to couple to a locking feature 54 on the top surface 36 of the anchor 24. The coupling feature 52 has an exterior surface 56 and an interior surface 58 which couples to lock feature 54 defined in the top surface 36 of the anchor 24. The elastic members 28 can be disposed within a fabric tube which limits the extension of the elastic members 28. The spring constant of the elastic member 28 can be set on expected wave size as well as the mass of the boat 22.

The tension devices 28 are generally illustrated to include an elastic member 28A and an inelastic member 28B. The elastic member 28A has a length between a first end and a second end. The length is an elastically variable length under tension. In the embodiment illustrated, the elastic member 28A is tubular and unitarily constructed of latex rubber. The elastic member 28A may be elongated under tension from a first length without any tension to a longer length that is greater than 200% of the first length. Preferably, the length of the elastic member 28A may be elastically elongated at least 300%. In one particular application, the elastic member may be elastically elongated at least approximately 400%. The strength capabilities of the elastic member 28A are significantly improved as compared to conventional, solid elastic lines.

The elastic member 28A may be formed by extruded molding and may include enlarged portions proximate the first and second ends 76 and 78. In one particular application, the elastic member 28A may have an outer diameter of approximately 5/18" and an inner diameter of 1/4" over the central portion between the enlarged ends 76 and 78 (i.e., along most of the length) and the enlarged portions 76 and 78 may have a maximum diameter of approximately 7/8". In another particular application, the central portion may have a dimeter of 11/16", an inner diameter of 3/16" and a maximum diameter of the enlarged ends 76 and 78 of 15/16". The outer diameter of the central portion may be between 5/8" and 11/16". In the embodiment illustrated, the enlarged portions 76 and 78 are hollow. However, the enlarged portions 76 and 78 may be solid within the scope of the present teachings. In the embodiment illustrated, the elastic member 28A may be latex rubber.

The inelastic member 28B is illustrated to include an outer covering or tubular sleeve 28C surrounding the length of the elastic member 28A. The inelastic member 28B may further include intermediate members 28D. The sleeve 28C may be connected to the elastic member 28A through the intermediate members 28D. The intermediate members 28D may be constructed of a loop of inelastic polypropylene webbing. The sleeve 28C of the inelastic member 28B may be similarly constructed of an inelastic polypropylene webbing.

The smaller diameter central portion of the elastic member 28A passes through openings 80 in the intermediate members 28D. The openings 80 have a diameter greater than the smaller diameter central portion of the elastic member 28A, but smaller than a maximum diameter of the enlarged portions at the first and second ends 76 and 78. In this manner, the first and second ends 76 and 78 are retained within the closed loop defined by the intermediate members 28D. The openings 80 may be reinforced with metal in a manner known in the art.

The elastic member 28A and the intermediate members 28D are passed through the inelastic sleeve 28B such that the intermediate members 28D extend beyond the inelastic sleeve 28B. The ends of the inelastic member 82 and 84 are sewn or otherwise fixedly attached to the intermediate members 28D.

While inelastic, the sleeve 28B may be bunched along the length of the elastic member 28A (as shown in FIG. 7*a*) to shorten the distance between its two ends 82 and 84. When the elastic member 28A is put under tension, the distance between the two ends of the inelastic member 28B increases (as shown in FIG. 7*b*). It must be noted that FIGS. 7*a* and 7*c* are not drawn to scale with FIGS. 7*b* and 7*d*.

In one particular application, the reduced diameter central portion of the elastic member 28A has a length of approximately 8.0". This length is an elastically variable length that may be stretched under tension to at least approximately 28.0". The maximum distance D2 between the ends 82 and 84 of the inelastic sleeve 28B limit elongation of the elastic member 28A to a second length. In other applications, the elastic member 28A may have a shorter or a longer unstretched length. In this regard, the elastic member 28 may have an unstrectched length of 6.0", 10.0", 18.0" or any other length within the scope of the present teachings. These other lengths may have the elongation characteristics described herein.

In the embodiment illustrated, the second length corresponds to an elongation of the elastic member 28A of approximately 24 inches (to a total of 32 inches) or 400%. A spring constant of the elastic member 28 can be set based on expected wave size as well as the mass of the boat 22.

FIGS. 9*a*-9*c* and 11 *a*-11*e* represents anchors 24 according to the present teachings. The anchor 24 top surface 36 can have a pair of arcuate cavities 60 which have interior surfaces 61 which interface with the surfaces 56 and 52 of the coupling feature 52 of the insertion tool 32. The exterior paddles 40 has an exterior curved surface 62 which interacts with sand under the ground surface 23. The paddles 40 extend past the radial exterior surface 64 of the anchor 24. Projecting from an underside of the anchor 24 is a crossed pair of tapered flanges 68 which function to displace sand and allow it to flow up adjacent to the paddles 40 to a location above the anchor.

The various views of the anchor 24 show. Projecting from the underside of the anchor 24 is the crossed pair of tapered flanges 68 which function to displace sand and allow it to flow up adjacent to the paddles 40 to a location above the anchor 24. The tapered flanges 68 can have extended flat surfaces 70 which intersect on a flat circular surface 72 which is disposed adjacent to a conical portion 74.

FIGS. 12*a*-12*d* represent an alternate anchor 24' according to the present teachings can have three tapered flanges 68 which function to displace sand and allow it to flow up adjacent to the paddles 40 to a location above the anchor. The paddles 40 extend past the radial exterior surface 64 of the anchor 24.

FIG. 13 represents load vs insertion depth. As can be seen, the pull out load for the anchor 24 depending on depth the anchor 24 is positioned is below the surface. As can be seen, the increase in load is exponential with respect to the depth the anchor is positioned below the surface of the earth.

The anchor 24 has features which are helpful for proper function. The overall perimeter profile/shape characteristics of the disc. The top profile design as "circular with paddles". The base circular design is used because it is the most efficient shape for application (insertion) processes. Also, the optional uniform distance from center (radius) of the circle. The nodes or paddles on the exterior of the base circle are there for multiple purposes. (1) they reduce the contact area (friction) with the outside of the bore during application and (2) the offset from the base circle that they provide creates the slurry gap for slurry to escape through.

The slurry gaps created between the paddles are required to allow slurry material and water to pass through them during insertion and removal. The material displaced during insertion will have passed through these gaps during the process of insertion and the same volume of material will pass in the opposite direction during removal. The length and width of the slurry gap is designed to be adequate to pass the amount of material required in the intended time period without creating a back pressure. The slurry gap could be larger than needed without suffering adverse effects, but being too small would hinder insertion and removal.

On the lower face of the anchor the slurry fins on the bottom of the disc have multiple functions. The cutting face of the fins are intended to scape at the surface of the packed sand and liberate the individual grains from their packed state. The sides of the fins then work to agitate the available water and loose sand to generate a slurry material. The downward force applied to the applicator then utilizes the disc as a plunger and displaces the slurry material to the top side of the disc. By agitating instead of rotating the applicator, we do not create a definitive direction for materials to move which allows the water sent to the top side of the disc to return to the bottom side (via the slurry gaps) to repeat the slurry process instead of simple being pumped to the top side. This leaves the top side naturally settled and free of water. After the anchor gets below the surface of the ground or sand, the sand on the top side immediately begins to settle and seal around the applicator stem.

With the advent of boating season, many boats congregate out in water side by side. A typical way to stabilize the boat within the water is to drop an anchor. Many anchors are unwieldy and also present an obstacle in the water to waders around the boat. Furthermore, if the current is great enough, sometimes the boat will still tend to drift out of position over time, thereby increasing the likelihood of collision with another anchored boat nearby.

To improve on stabilizing the boat position, a system for anchoring the boat beneath the sand is provided. A retention disc contains an upper side and a lower side. The retention disc may be formed as an annular disc, wherein an opening may be created in the middle of the disc. Alternatively, an opening may be formed along the periphery of the disc for threading and securing a lead line therethrough. A lead line containing a first end and a second end may be secured in the disc annular opening (or in the disc peripheral opening) at the first end of the lead line, and secured at the second end (once the disc is buried in the sand) to the boat.

A plurality of ridges or slurry paddles, protruding from the disc, is formed on the bottom side of the disc. A plurality of recessed portions, or slurry chambers, is formed between the ridges for collecting sand slurry therein. The slurry paddles are designed to cut through the sand as the disc is rotatably positioned beneath the sand. More preferably, the slurry paddles or ridges may be formed in a geometric pattern, such as a cross, thereby resulting in a plurality of symmetric slurry chambers formed between the slurry paddles. In the embodiment containing the cross-shaped ridges, four quadrants are formed as slurry chambers on the bottom side of the disc. As also shown, each of four ridges forming the cross-shaped pattern extend radially outward from the center of the disc to the periphery or outer circumference of the disc.

As shown in the figures, another embodiment includes cross-shaped ridges and an inner ridge formed as a concentric circle formed within the outer circumference of the disc. If desired, the outer circumference of the disc may formed as a broken set of ridges wherein gaps in the outer circumference ridge are positioned to permit sand to exit from the inner slurry chambers as the disc is torqued into position beneath the sand. Alternatively, the outer circumference may not at all contain a ridge and may instead constitute a plurality of "gates" corresponding to each slurry chamber, wherein excess sand collecting within each slurry chamber may migrate radially outwardly as the disc is rotatably positioned beneath the sand. The area between the inner circle and the outer circumference constitute a first set of slurry chambers. A second area, between the inner circle paddles and the exact middle of the disc having an axis running orthogonal to either side of the disc, may constitute a second set of slurry chambers.

Four paddles may also be formed on the periphery of the disc at the 12:00, 3:00, 6:00, and 9:00 positions, thereby providing an additional means to cut through the sand as the disc is rotated.

As also shown in the figures, an interlocking recessed portion designed or configured to mate with an application tool may be formed in the middle portion of the upper side of the disc. A hollow tube forms the body of an applicator or application tool, wherein the applicator has a first end and a second end. Alternatively, a solid tube may form the applicator body. A pattern formed on the first end is designed or configured to fit within the interlocking recessed portion on the upper side of the disc, in a complementary or "lock and key" type of fit. As the applicator first end is fit within the interlocking recessed portion on the upper side of the disc, the applicator can then be used to torque the disc into the sand in a rotary motion. When the lead line is connected to the center of the disc, the lead line may extend through the hollow tube out the second end of the applicator as the applicator is being used to insert the disc within the sand. A handle is located on the second end of the applicator body and enables the operator to turn the applicator hollow tube as it fits within the disc, thereby imparting a rotary motion to the disc. Once the disc is secured within the sand, the hollow tube may be pulled up and out of the disc, thereby leaving the lead line attached to the disc that is now buried in the sand. The lead line second end may then be secured to the boat as desired.

In operation, as the disc is rotated by torqueing the applicator handle, the slurry paddles displace sand that is then deposited within the slurry chambers, from which sand may also migrate from the outer gates as explained above. It is believed that at the same time, a vacuum is also created beneath the disc within the slurry chambers, thereby contributing to the "locked" position of the disc beneath the sand.

In further accordance with the invention, one or more discs with load lines may be used to secure the boat or watercraft. The load lines may be calibrated to resistances of thirty, fifty, seventy-five, one hundred, or any other number of pounds. The discs may be sized to the desired average diameter such as the four-inch or six-inch diameter embodiments shown in the figures.

The disc may be removed by reinserting the hollow tube over the lead line and then re-engaging the interlocking recessed portion and providing a reverse turn to the disc. Alternatively, the lead line may be pulled to displace the sand about the disc and thereby break the "vacuum" that holds the disc in place beneath the sand.

The same small amount of water is recycled again and again within the "slurry envelope" created below the sand surface. Only when the applicator tube is removed is there a pathway for this water to escape. The specific dimensions of the slurry teeth varies from size to size. The cutting face of the teeth should be as narrow as possible (without risk of breaking) to provide the best results. The fin height can be between ¼" and ¾" an preferably about ½". Any taller is not necessary and any shorter cramps the slurry chamber space and effects insertion. Generally, devices with a diameter of less than 3" start becoming more difficult to insert due to less turbulent water effects in the slurry chamber because of the shorter fin sweeps.

As illustrated, the tension device 28 couples the boat 22 to a fixed point. The length of the tension device 28, in general, and the elastic member 28A may be selected such that a constant tension is maintained between the fixed anchor point and the boat 22. As such, the floating structure 22 is prevented from building an unrestrained velocity that is otherwise forced to come to a hard stop and resultantly deliver a significant higher impact force at the anchor site. The tension device 28 provides for resistive tension under all normal operating conditions (without lockout). The additional travel and strength potential of the elastic member 28A provides for travel under constant tension. The inelastic member 28B limits travel outside of normal operating conditions and prevents failure. Energy spikes from force multiplies from impact are prevented. The elastic member 28A may be further selected to provide a predetermined and calibrated elongation. As addressed above, this elongation of the elastic member 28A is advantageously great than 200%, preferably at least 300%, and in some applications at least about 400%. As the elongation of the elastic member 28A increase, the amount of tension increases. The length of the inelastic member 28B is selected to limit elongation of the elastic member 28A. For example, the length of the inelastic member 28B may be selected to limit elongation of the elastic member 28A so as to prevent failure but maintain tension between the fixed anchor point and the floating structure 22 for a desired application.

The tension device 28 of the present teachings is described above with regard to one particular application. It will be understood, however, that the scope of the present teachings is not limited to this particular application. In this regard, the tension device 28 may be used in alternative applications for securing a floating structure relative to a fixed point. The fixed point may be ground, a dock, or other structure. For example, the tension device 28 of the present teachings may be used for docked marine vessels (keeping centered in slip), in-line buffers for weighted moorings and anchors, shock absorbers for ski and tubing two ropes, and tension hardware for floating docks and rafts. The tension devices 28 may also be under a ski ramp to maintain placement of the ski ramp.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for securing a floating structure comprising:

an anchor including a disc shaped member, a plurality of paddles and a plurality of flanges, the disc shaped member having a top surface defining a locking surface, a bottom circular surface, and a periphery surface disposed between the top and bottom surfaces, the disc shaped member further having a diameter greater than a height, the plurality of paddles radially extending from the periphery surface, the plurality of flanges being on the bottom surface; and a tension device coupled to the anchor, the tension device including an elastic member and an inelastic member, wherein the inelastic member limits elongation of the elastic member.

2. The securing system according to claim 1, wherein the elastic member has an elastically variable length elongatable at least 300%.

3. The securing system of claim 1, wherein the elastic member has an elastically variable length elongatable at least approximately 400%.

4. The securing system according to claim 3, wherein the inelastic member is an inelastic sleeve that limits elongation of the elastic member.

5. A tension device for coupling a floating structure to a fixed point in combination with an anchor, the tension device comprising:

an elastic member having a length extending in a first direction between a first end and a second end thereof, the length being elastically variable under tension, the elastic member having a central portion with a first diameter and first and second enlarged portions at the first and second ends, respectively, the enlarged portions both having a maximum diameter;

an inelastic member for limiting elongation of the length of the elastic member; and first and second intermediate members defining first and second openings, respectively, the first and second openings both having an opening diameter greater than the first diameter and less than the maximum diameter to prevent the first enlarged portion from being pulled through the first opening and the second enlarged portion from being pulled through the second opening;

wherein the tension device has a first length when the elastic member is not under tension and a longer length when the elastic member is elastically stretched by a tension force;

wherein the inelastic member limits elastic elongation of the elastic member to a second length;

wherein the first and second intermediate members are defined by first and second closed loops of fabric, respectively, the first and second openings of the first and second intermediate members formed in first and second portions of the first and second intermediate members, respectively, the first and second portions both extending perpendicular to the first direction; and wherein the anchor Includes a disc shaped member, a plurality of paddles and a plurality of flanges, the disc shaped member having a top surface defining a locking surface, a bottom circular surface, and a periphery surface disposed between the top and bottom surfaces, the disc shaped member further having a diameter greater than a height, the plurality of paddles radially extending from the periphery surface, the plurality of flanges being on the bottom surface, the tension device coupled to the anchor.

6. The tension device of claim 5, wherein the elastic member has an elastically variable length elongatable more than 200%.

7. The tension device of claim 5, wherein the elastic member has an elastically variable length elongatable at least 300%.

8. The tension device of claim 5, wherein the elastic member has an elastically variable length elongatable at least approximately 400%.

9. The tension device of claim 5, wherein the inelastic member is an inelastic sleeve that limits elongation of the elastic member.

10. The tension device of claim 5, wherein the elastic member is a hollow tube.

11. The tension device of claim 5, wherein first and second ends of the inelastic member are attached to the first and second intermediate members, respectively.

12. The tension device of claim 5, wherein the first and second closed loops of fabric both include a proximal portion surrounding a respective one of the first and second enlarged ends.

13. A method of securing a floating structure relative to a fixed point, the method comprising:

providing a tension device including an elastic member, an inelastic member and first and second intermediate members, the inelastic member surrounding the elastic member, the elastic member passing through first and second openings in the first and second intermediate members, the elastic members including first and second enlarged portions both with a diameter greater than the first and second openings, respectively, to prevent the first enlarged portion from being pulled through the first opening and the second enlarged portion from being pulled through the second opening, the tension device having a first length when no subject to tension forces, the first and second intermediate members defined by first and second closed loops of fabric, respectively, the first and second openings of the first and second intermediate members formed in first and second portions of the first and second intermediate members, respectively, the first and second portions both extending perpendicular to the first direction;

providing an anchor including a disc shaped member, a plurality of paddles and a plurality of flanges, the disc shaped member having a top surface defining a locking surface, a bottom circular surface, and a periphery surface disposed between the top and bottom surfaces, the disc shaped member further having a diameter greater than a height, the plurality of paddies radially extending from the periphery surface, the plurality of flanges being on the bottom surface;

connecting the floating structure to the fixed point with the tension device; connecting the tensioning device to the anchor;

elongating the elastic member by more than 200%; and limiting elongation of the elastic member with the inelastic member.

14. The method of claim 13, further comprising maintaining a constant tension at the fixed point with the tension member.

15. The method of claim 13, wherein elongating the elastic member includes elongating the elastic member by at least 300%.

16. The method of claim 13, wherein elongating the elastic member includes elongating the elastic member by at least approximately 400%.

17. The method of claim 13, wherein the elastic member is a hollow tube with first and second enlarged ends.

* * * * *